US006533360B1

(12) United States Patent
Parkel et al.

(10) Patent No.: US 6,533,360 B1
(45) Date of Patent: Mar. 18, 2003

(54) CHAIR FOOTREST

(76) Inventors: Yvonne Parkel, 106 6th Eloise St., Winter Haven, FL (US) 33880; Robert Clark, 106 6th Eloise St., Winter Haven, FL (US) 33880

( * ) Notice: Subject to any disclaimer, the term of this patent is extended or adjusted under 35 U.S.C. 154(b) by 0 days.

(21) Appl. No.: 09/626,754

(22) Filed: Jul. 27, 2000

(51) Int. Cl.[7] ..... A47C 20/00
(52) U.S. Cl. ..... 297/423.28
(58) Field of Search ..... 297/423.26, 423.28, 297/463.1

(56) References Cited

U.S. PATENT DOCUMENTS

| | | | | |
|---|---|---|---|---|
| 399,049 | A | | 3/1889 | Keller |
| 923,529 | A | | 6/1909 | Ingraham |
| 961,311 | A | * | 6/1910 | Nelson |
| 1,766,840 | A | | 6/1930 | Rose |
| 1,796,526 | A | | 3/1931 | Laraia |
| 2,458,618 | A | * | 1/1949 | McDonald |
| 2,696,868 | A | | 12/1954 | Miller ..... 155/29 |
| 3,376,067 | A | | 4/1968 | Kernes ..... 297/427 |
| 4,470,634 | A | * | 9/1984 | Delius et al. |
| 4,919,478 | A | * | 4/1990 | Tacker |
| 5,306,074 | A | | 4/1994 | Mocur ..... 297/423.31 |
| 5,505,519 | A | * | 4/1996 | Natt |

* cited by examiner

*Primary Examiner*—Milton Nelson, Jr.
(74) *Attorney, Agent, or Firm*—Baker, Donelson, Bearman & Caldwell

(57) ABSTRACT

A chair (10) is disclosed having a pedestal (11) coupled to a seat portion (12) to which is coupled to a backrest (13), a footrest (15) and a pair of arms (16). The footrest (15) includes a pair of spaced-apart mounting members (18), a U-shaped foot supporting member (19) pivotally coupled to the mounting members (18) through hinges (21), and a pair of guiding brackets (23) extending between the mounting members (18) and the foot supporting member (19). Each guiding bracket (23) has an elongated rail (24) and a post (26) extending through a slot (25) in the rail (24).

12 Claims, 3 Drawing Sheets

CHAIR FOOTREST

TECHNICAL FIELD

This invention relates generally to chairs for use with styling hair, and more particularly to footrests for such chairs that can be moved from a foot supporting position to a stowed position.

BACKGROUND OF THE INVENTION

Hair stylists and the like typically utilize a pivoting chair while styling the hair of an individual. Usually, these chairs are equipped with a U-shaped footrest which extends downwardly from the front of the chair's seat. Even though these chairs are hydraulically driven to raise and lower the seat portion relative to the underlying floor, elderly or handicapped individuals find it difficult to enter into and remove themselves from these chairs. This difficulty arises from the inaccessibility of the seat due to the positioning of the frontwardly extending footrest. Oftentimes, with the limited physical capabilities of these individuals, they are unable to maneuver themselves from a body supporting device, such as a cane, a wheelchair or a walker, over the footrest and onto the seat. As such, these individuals must be hoisted into these chairs which is inefficient for the hair stylists and causes the individuals to experience not only the discomfort of being hoisted, but also the indignity associated with needing to be hoisted even for a simple task such as sitting in a hair stylist's chair. Alternatively, these individuals must be seated on conventional, non-pivoting chairs, thus also making the hair stylist's job considerably more difficult to complete.

Accordingly, it is seen that a need remains for a chair which enables a person with limited mobility to access the chair seat but which still enables the feet of a seated individual to be supported. It is to the provision of such therefore that the present invention is primarily directed.

SUMMARY OF THE INVENTION

In a preferred form of the invention a chair footrest comprises a pair of spaced apart mounting members adapted to be mounted to a chair, a foot supporting member, a pair of hinges movably coupling the foot support member to the pair of mounting members, and at least one guiding bracket coupled to at least one of the mounting members and the foot supporting member. The guiding bracket has an elongated rail having one end mounted to the mounting member and having an elongated slot therein and a post mounted to the foot supporting member extending through the slot of the rail. The post includes means for selectively preventing the movement of the rail relative to the post. With this construction and with the mounting members mounted to a chair, the foot supporting member may be hingedly moved between a foot supporting position and a stowed and locked position beneath the chair to allow access to the chair.

DETAILED DESCRIPTION

Figure 1:
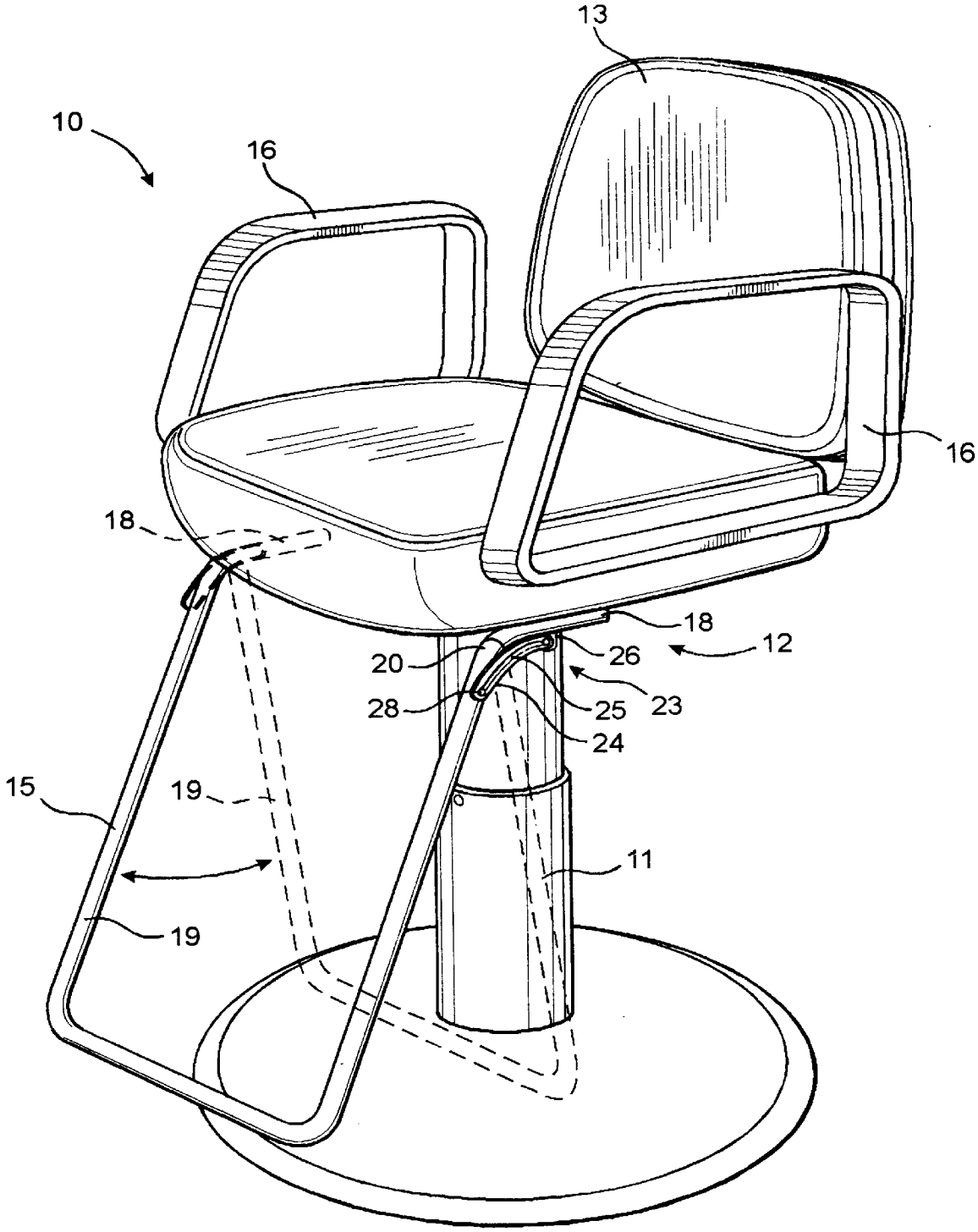
FIG. 1 is a perspective view of a chair embodying principles of the invention in a preferred form.

With reference next to the drawings, there is shown a chair 10, in the form of a hair stylist chair, having a hydraulically driven pedestal or frame 11 depending from the seat portion 12. The chair 10 includes a backrest 13, a footrest 15 and a pair of arms 16, all of which are coupled to the seat portion 12 through unshown mounting screws.

The footrest 15 includes a pair of spaced apart mounting members 18 secured to an underside of the seat portion 12 and a U-shaped foot supporting member 19. The mounting members 18 and the foot supporting member 19 are preferably comprised of aluminum tubes. A pair of hinges 21 pivotally couple the ends 20 of the U-shaped foot supporting member 19 to the mounting members 18. A pair of guiding brackets 23 extend between the mounting members 18 and the foot supporting member 19.

Figure 2:
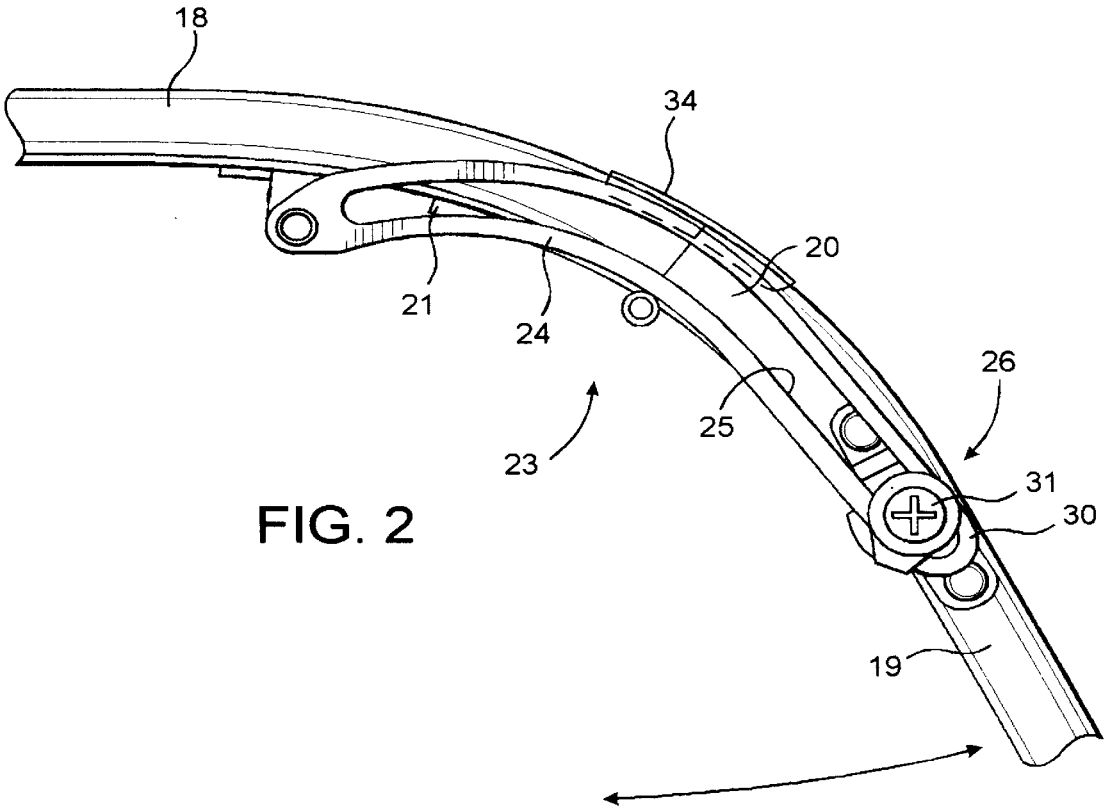
FIG. 2 is a side view of a portion of a footrest of the chair of FIG. 1.
Figure 3:
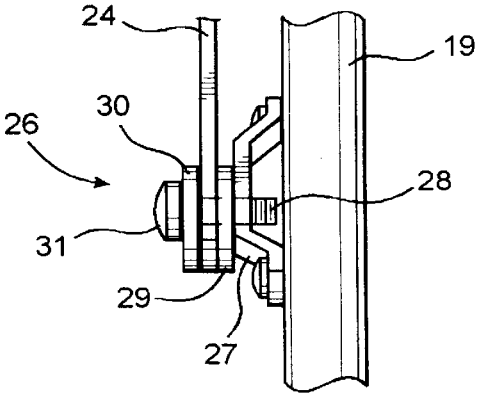
FIG. 3 is a partial front view of the footrest portion of FIG. 2.

As best shown in FIG. 2, each of the guiding brackets 23 has an elongated rail 24 having one end pivotally mounted to the mounting member 18 and an elongated slot 25 therein. A post 26 is fixedly mounted to the foot supporting member 19 and extends through the slot 25 of the rail 24. The post 26, as best shown in FIG. 3, includes a threadable bolt or screw 28 threadably mounted to a spacing bracket 27. The spacing bracket 27 is mounted to the foot supporting member 19 for spacing the rail 24 apart from the foot supporting member. An inside washer 29 is positioned upon the bolt 28 between the spacing bracket 27 and the rail 24. An outside washer 30 mounts between the rail 24 and a head 31 of the bolt 28.

In use, an operator, such as a hair stylist wishing to seat an individual upon the chair 10, first loosens the guiding bracket bolts 28 thereby allowing the movement of the inside and outside washers 29 and 30 away from each other. This movement of the washers frictionally releases the guiding bracket rails 24 captured therebetween so as to allow movement of the rails 24 relative to the post 26. Once the rails 24 are released, the foot supporting member 19 may be manually pivoted from its foot supporting position, shown in FIG. 1, to its stowed position beneath the seat portion 12, as shown in phantom lines in FIG. 1. With the foot supporting member 19 stowed completely beneath the seat portion 12, an individual's access to the seat portion 12 is unencumbered by the foot supporting member 19, a problem which has long existed with chairs of the prior art. As such, an elderly or handicapped individual with limited mobility may move to and stand directly in front of the seat portion 12 while attempting to position themselves upon the chair 10. If desired, the bolts 28 may be tightened to lock the position of the foot supporting member 19 in its stowed position or in another position while the individual enters the chair. The tightening of the bolts 28 moves the outside and inside washers 29 and 30 towards each other so as to selectively capture the rail 24 therebetween. In this manner, the foot supporting member 19 may be selectively positioned for use as a step to assist an individual in entering the chair 10 by stepping upon the foot supporting member 19 and pushing against the foot supporting member to properly situate themselves on the seat 12 of the chair.

Once the individual is properly seated upon the chair 10, the bolts 28 are loosened and the foot supporting member 19 is pivoted back to its foot supporting position. The bolts 28 are then retightened to lock the position of the foot supporting member 19, as previously described.

It may be desirable to include a pair of protective shields 34 coupled to the mounting member 18. Preferably, the protective shields 34 are metal or plastic plates shaped and sized to conform to fit snugly against the mounting member 18. The protective shields 34 are positioned over the junctions of the mounting members 18 and the foot supporting member 19 to prevent objects, such as clothing or even the skin of individuals utilizing the chair, from being pinched between the foot supporting member ends 20 and the mounting members 18. This safety feature may be needed especially during the repositioning of the foot supporting member 19 from its stowed position to its foot supporting position.

Figure 4:
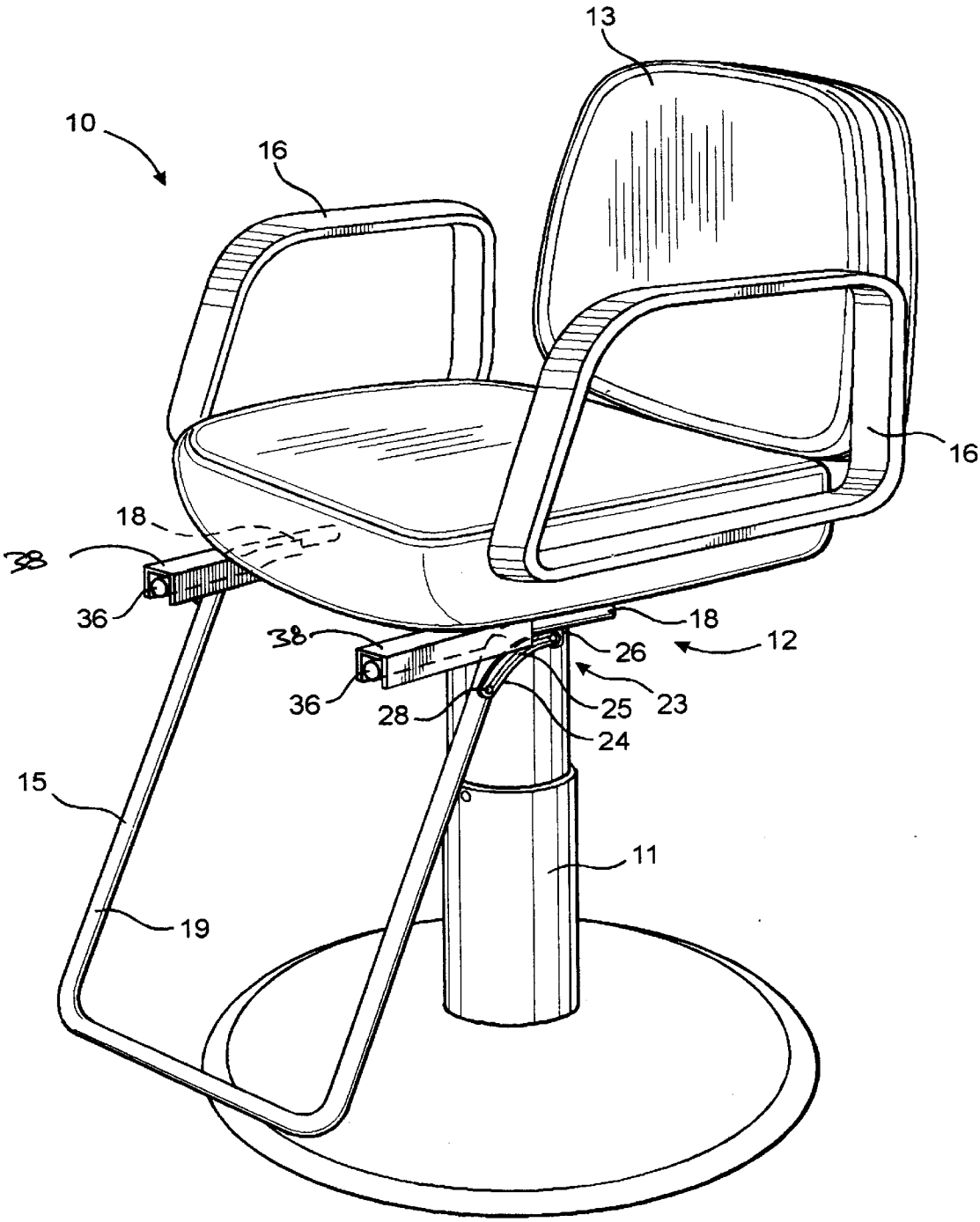
FIG. 4 is a perspective view of the chair of FIG. 1 including an additional supporting handle.

Turning to FIG. 4, the footrest 15 may also include an ancillary handle 36 mounted adjacent the junction of a mounting member 18 and the foot supporting member 19, as shown in FIG. 4. The handle 36 may be mounted to the mounting member 18 or to the underside of the seat portion 12. Preferably, the handle 36 extends outwardly from the chair seat 12 in a horizontal direction. A grip 38 attaches to each of the handles 36. Each of the grips 38 is preferably comprised of a plastic sheet of material. Of course, any material that provides some cushioning for one's hands against the handles 36 may be used for the grip 38. Each of the grips 38 may also be extended downwardly from the handles 36 to provide a cover that visually hides the guiding brackets 23 from the view of other customers in a hair salon in adjacent chairs.

The handle 36 and the grip 38 enable one to support a portion of his or her body weight upon the handle as he or she moves into and out of the chair 10. This additional feature provides much needed stability to an elderly or handicapped person. It should be appreciated that the handle 36 is preferably used in combination with the foot supporting member 19 to enable an elderly or handicapped person to enter the chair 10 incrementally. In a first incremental movement, a person places a foot on the foot supporting member 19 which has been selectively positioned for the person to step thereupon and pushes himself by foot at least partially into the chair seat 12. Because the foot supporting member 19 is hinged to the mounting members 18 by hinges 21, the foot rest 15 is capable of supporting the weight of an ordinary person placed upon the foot supporting member 19 in its stowed position or in its foot supporting position or even in a freely swinging position.

In a second movement, the person places his hand upon the handle 36 and further pushes himself by hand into the chair seat 12. Once supported upon the chair seat 12, the foot supporting member 19 may be extended to its foot supporting position whereupon the seated person may further push against the foot supporting member to move his buttocks firmly into the seat and his back against the chair backrest 13. In this manner, persons may use their feet and hands to incrementally step into a hair stylist's chair 10 using the foot supporting member 19 and the handle 36 in sequence or in combination as desired. It should be appreciated that the foot supporting member 19 may support an individual's weight in any of its positions, whether stowed, extended or swinging in between the stowed and the extended positions.

As an additional safety feature, the handle 36 may be designed to overlay the junction of the foot supporting member end 20 and the mounting member 18 in a manner similar to the previously described protective shield 34. The handle 36 may also be fitted with a grip having an ample amount of cushioning thereon to assist one in gripping the handle and cushioning one's hand while pushing thereon.

It should be understood that the guiding bracket 23 enables the foot supporting member 19 to be locked in any position between its foot supporting position and its stowed position by simply tightening the guiding bracket bolts 28. It should be understood that the threaded bolts 28 shown in the preferred embodiment may be replaced with conventionally known quick release camming handles or other known equivalent devices which frictionally hold and release the rail 24 through relative movement of the washers 29 and 30 as the camming handle is actuated. Also, the locking mechanism may utilize other conventionally known methods of locking as an alternative to the frictional locking shown in the preferred embodiment. Furthermore, the chair may be outfitted with an additional handle the actuation of which causes the pivoting movement of the foot supporting member. Lastly, the relative mounting positions of the rail 24 and post 26 may, of course, be reversed or inverted wherein the rail is mounted to the foot supporting member 19 and the post is mounted to the mounting member 18.

It thus is seen that a chair footrest is now provided which may be used for the elderly or handicapped. While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. A chair footrest comprising:

a pair of spaced apart mounting members adapted to be mounted to a chair;

a foot supporting member;

a pair of hinges movably coupling said foot supporting member to said pair of mounting members;

at least one guiding bracket coupled to at least one said mounting member and said foot supporting member, said guiding bracket including an elongated rail having one end mounted to said mounting member and having an elongated slot therein and a post mounted to said foot supporting member extending through said slot of said rail, said post including means for selectively preventing the movement of said rail relative to said post; and a pair of shields, wherein each shield is positioned over a junction of said foot supporting member and one said mounting member, whereby with the mounting members mounted to a chair the foot supporting member may be hingedly moved between a foot supporting position and a stowed and locked position beneath the chair to allow access to the chair, and whereby the shield prevents objects from being pinched between the foot supporting member and the mounting members.

2. The chair footrest of claim 1 wherein said means for preventing movement includes a first member, mounted upon a first side of said rail, a second member mounted to a second side of said rail opposite said first member and means for moving said first and second members towards and away from each other so as to capture a portion of said rail between said first and second members.

3. The chair footrest of claim 2 wherein said means for preventing movement of said rail relative to said post comprises a threaded bolt.

4. The chair footrest of claim 1 further comprising a handle mounted over said junction of said foot supporting member and one said mounting member, whereby a person accessing the chair may partially support himself or herself upon the handle.

5. A chair comprising a seat portion;

a backrest portion coupled to said seat portion;

a frame supporting said seat portion above a supporting surface;

a footrest having a foot supporting member, a pair of spaced-apart mounting members adapted to be mounted adjacent said seat portion, a pair of hinges movably coupling said foot supporting member to said pair of mounting members, and at least one guiding bracket coupled to at least one of said mounting members and to said foot supporting member, said guiding bracket having an elongated rail having one end mounted to said mounting member and having an elongated slot therein and a post mounted to said foot supporting member extending through said slot of said rail, said post including means for selectively preventing the movement of said rail relative to said post; and a pair of shields, wherein each shield is positioned over a junction of said foot supporting member and one of said mounting members, whereby with the mounting members mounted to a chair, the foot supporting member may be hingedly moved between a foot supporting position and a stowed and locked position beneath the chair to allow access to the chair, and whereby the shield prevents objects from being pinched between the foot supporting member and the mounting members.

6. The chair footrest of claim 5 wherein said means for preventing movement includes a first member mounted upon a first side of said rail, a second member mounted to a second side of said rail opposite said first member and means for moving said first and second members towards and away from each other so as to capture a portion of said rail between said first and second members.

7. The chair footrest of claim 6 wherein said means for preventing movement comprises a threaded bolt.

8. The chair footrest of claim 5 further comprising at least one handle mounted over said junction of said foot supporting member and one of said mounting members, whereby a person accessing the chair may partially support himself or herself upon the handle.

9. A chair footrest comprising:

a pair of spaced-apart mounting members adapted to be mounted to a chair;

a foot supporting member;

a pair of hinges movably coupling said foot supporting member to said pair of mounting members;

at least one guiding bracket coupled to at least one said mounting member and said foot supporting member, said guiding bracket having an elongated rail having one end mounted to said foot supporting member and having an elongated slot therein, and a post mounted to said mounting member extending through said slot of said rail, said post including means for selectively preventing the movement of said rail relative to said post; and a pair of shields, wherein each shield is positioned over a junction of said foot supporting member and one said mounting member, whereby with the mounting members mounted to a chair the foot supporting member may be hingedly moved between a foot supporting position and a stowed and locked position beneath the chair to allow access to the chair, and whereby the shield prevents objects from being pinched between the foot supporting member and the mounting members.

10. The chair footrest of claim 9 wherein said means for preventing movement includes a first member mounted upon a first side of said rail, a second member mounted to a second side of said rail opposite said first member and means for moving said first and second members towards and away from each other so as to capture a portion of said rail between said first and second members.

11. The chair footrest of claim 10 wherein said means for preventing movement comprises a threaded bolt.

12. The chair footrest of claim 9 further comprising a handle mounted over a junction of said foot supporting member and one said mounting member, whereby a person accessing the chair may partially support himself or herself upon the handle.

* * * * *